US005758482A

United States Patent [19]

Hoover

[11] Patent Number: 5,758,482

[45] Date of Patent: Jun. 2, 1998

[54] SLIVER STOP MOTION FOR SPINNING MACHINE

[75] Inventor: Donald Lynn Hoover, Cramerton, N.C.

[73] Assignee: American Linc Corporation, Gastonia, N.C.

[21] Appl. No.: 658,149

[22] Filed: Jun. 4, 1996

[51] Int. Cl.[6] ..... D01H 13/18

[52] U.S. Cl. ..... 57/87; 28/226; 57/86; 57/315

[58] Field of Search ..... 57/80, 81, 86, 57/87, 315; 19/0.2, 0.25, 0.26; 28/225, 226, 234

[56] References Cited

U.S. PATENT DOCUMENTS

| | | | |
|---|---|---|---|
| 279,870 | 6/1883 | Hendee | 57/80 |
| 1,102,213 | 6/1914 | Ewing | 28/226 |
| 1,103,329 | 7/1914 | Vales . | |
| 1,442,873 | 1/1923 | Garey . | |
| 1,509,234 | 9/1924 | Garey . | |
| 1,973,552 | 9/1934 | Williamson | 57/87 |
| 2,153,436 | 4/1939 | Scholz | 57/87 |
| 2,734,335 | 2/1956 | Saunders et al. | 57/86 |
| 3,271,823 | 9/1966 | Whitehurst . | |
| 3,394,541 | 7/1968 | Rhyne . | |
| 3,452,531 | 7/1969 | Watson . | |
| 3,555,218 | 1/1971 | Adams et al. | 57/81 |
| 3,726,072 | 4/1973 | Ford et al. . | |
| 3,832,839 | 9/1974 | McClure . | |
| 3,841,076 | 10/1974 | Ford et al. . | |
| 4,376,516 | 3/1983 | Leu | 242/36 |
| 4,538,328 | 9/1985 | Stahlecker . | |
| 4,922,702 | 5/1990 | Meyer | 57/87 |
| 5,211,709 | 5/1993 | Hussey | 57/87 |
| 5,363,639 | 11/1994 | Stahlecker et al. . | |

FOREIGN PATENT DOCUMENTS 418291 1/1933 United Kingdom .

OTHER PUBLICATIONS

OPTISTOP™, OPTISTOP™ Motion Sensor (Brochure), MHT, Inc.

*Primary Examiner*—William Stryjewski

*Attorney, Agent, or Firm*—Allen, Dyer, Doppelt, Milbrath & Gilchrist, P.A.

[57] ABSTRACT

An apparatus and method for interrupting delivery of sliver to a spinning frame for spinning sliver into yarn and winding the yarn onto a spindle utilizing a sliver stop motion. The sliver stop motion is positioned on a respective drafting system of the spinning frame. The sliver stop motion is mounted to the spinning frame so as to overlie the back drafting rolls for stopping the motion of sliver being drafted by the back drafting rolls responsive to a break in yarn being wound onto the spindle. The stop motion includes an elongate pivoting member which is pivotally mounted to a frame mounting member. The frame mounting member is pivotally mounted to the spinning frame. At the stop motion's proximal end, a yarn contact member extends outwardly therefrom so as to underlie and slidably contact yarn being directed to the respective spindle. A sliver comb is connected to and extends outwardly from the distal end of the elongate pivoting member so as to overlie sliver being drafted by the back drafting rolls. Therefore, during a break in yarn being wound onto the spindle or otherwise, the yarn contact member responsively moves upward from the broken yarn and the sliver comb responsively moves downward to engage the sliver during pivotal movement of the elongate pivoting member. The sliver engaged by the sliver comb is responsively broken under the forces of the continuously operating drafting rolls and the retention of the sliver by the sliver comb.

29 Claims, 4 Drawing Sheets

SLIVER STOP MOTION FOR SPINNING MACHINE

FIELD OF THE INVENTION

The present invention is directed to an apparatus and method for monitoring breakage of attenuated strands issuing from drafting rolls of a textile machine for spinning sliver into yarn and, upon a break, severing and entrapping the sliver to interrupt further passage into the drafting system.

BACKGROUND OF THE INVENTION

The quality of end textile product, such as yarn, is, to a significant degree, dependent upon the quality of the textile yarn forming operation. Further, the cost efficiency of a textile machine, such as a sliver spinning apparatus, is dependent upon its conservative use of stock material and its continued operation. And, of course, the cost of the textile product to the end user is dependent upon all of the above.

Generally, conventional spinning apparatuses or spinning frames include a plurality of drafting systems arranged in a series along the machine. Such drafting systems typically include arrangements of paired rollers through which textile material passes. Stock material, such as sliver, is introduced to a pair of back drafting rolls and then is passed through the back drafting rolls to the front drafting rolls as an attenuated strand. The attenuated strand has twist inserted thereinto in a generally known manner in order to form yarn. During normal operation, the formed yarn is then wound about a respective spindle.

If breakage of the sliver, the attenuated strand, or the formed yarn issuing from the drafting system occurs, a vacuum end collection nozzle draws materials delivered through the drafting rolls into a waste collection chamber. If a breakage of the attenuated strand is left unattended, the drafting rolls continuously draft the stock material causing significant collection of costly sliver into the waste collection system. Excessive waste in the waste collection system also results in the degradation of the quality of the yarn produced due to reworking of the waste material. Further, and in many instances even more detrimental, the sliver continues to be issued from the drafting rolls causing substantial lap-up of the material which may cause significant damage to the respective drafting system as well as adjacent systems which continuously operate.

Conventionally, textile mills follow the practice of providing operators to reinstitute production at a drafting system whenever there is a break anywhere along the attenuated strand or yarn issuing from the drafting rolls. This system, however, produces unnecessary waste of textile materials and the drafting systems may be damaged by strands permitted to lap-up around the drafting system. This process also results in substantial down-time of the affected drafting system or systems and involves a substantial amount of operator time.

The aforementioned problems associated with breakage of the attenuated strand of the issued sliver or the formed yarn may be avoided or, at least, significantly diminished, by providing means to automatically interrupt the delivery of the sliver to the drafting system once a break occurs. By interrupting delivery of the supply strands, lap-ups are reduced, vacuum end collection waste is significantly reduced, and both improved quality and greater efficiency results while simultaneously preventing harm to the spinning frame.

Prior art attempts have been directed to interrupting the drafting of sliver to the respective drafting system, but such attempts do not provide a complete and/or efficient manner of overcoming the aforementioned problems associated with spinning frames. Such attempts include sliver stop motions which provide a pivoting member mounted on a respective drafting system having one end which contacts the formed yarn as it is being spun about the spindle so that when there is a break therealong, the pivoting member pivots to interrupt sliver delivery to the system.

In order for mechanical pivoting members to be effective, however, proper balancing of the pivoting member is important to ensure proper operation of the sliver stop motion and to produce the requisite tension along the sliver/yarn line so as not to interfere with the quality of the end product or the effectiveness of the drafting system. It is also imperative that the sliver stop motion be adaptable to various machines requiring various yarn tensions. And further, the sliver stop motion must not interfere with the normal operation and maintenance of the spinning frame. Individual sliver stop motions may be accidentally or unavoidably jarred such as by an operator doffing the machine. Such unintentional jarring must not adversely affect the stop motion's normal operation. On the other hand, the sliver stop motion must be relatively inexpensive to make, easy to install, easily removed for maintenance, and be relatively uncomplicated, thereby requiring little maintenance.

An example of a prior art attempt is disclosed in the published British Patent Application No. 418,291 to Williamson ("the '291 patent application") which describes a sliver stop motion in the form of a rod which is pivotally attached to the frame of a spinning machine. The rod has, at one end, a plate for contacting the yarn between the feed rollers and the spindle to detect a breakage therebetween. On its other end, the rod has a gill for severing the sliver by catching the sliver between the grill and a metal plate when the rod pivots. The '291 patent application, however, fails to satisfy the requirements to effectively and efficiently interrupt the delivery of sliver to a spinning frame as discussed above. For example, the '291 patent application contains no provision for adjusting the pivoting operation so that the apparatus may be used on various textile machines for various applications. Nor does it accommodate normal maintenance of the spinning frame or retain the sliver subsequent to a break (it merely severs the sliver). It further makes no provision for absorbing unavoidable jolts or jars to the individual stop motions by, for example, an operator performing maintenance to the machine which may otherwise cause it to pivot and interrupt the normal spinning operation of the drafting system. It is reflective of the state of the art which does not provide a versatile, inexpensive, or efficient sliver stop motion to interrupt the delivery of sliver to the drafting system of a spinning frame.

SUMMARY OF THE INVENTION

It is, therefore, an object of the present invention to accomplish interruption of delivery of sliver into the drafting systems of textile yarn forming machines.

It is a further object of the present invention to provide means for interrupting sliver delivered to the drafting rolls which does not obstruct regular maintenance of the spinning frame such as, e.g., reinstitution of the yarn subsequent to a breakage of the attenuated strand.

It is another object of the present invention to reduce waste of sliver prepared for yarn formation by delivery of the sliver into a vacuum end collection system rather than forming it into yarn.

It is another object of the present invention to foster the proper maintenance of each drafting system arranged on the spinning frame by preventing lap-up of sliver or attenuated strand resulting from breakage thereof.

It is a further object of the present invention to provide a sliver stop motion which is relatively inexpensive to make, easy to install, easily removed for maintenance, adaptable to various yarns and machines, and is less complicated, thereby requiring less maintenance.

These and other objects, features, and advantages of the present invention are achieved by providing a unique sliver stop motion and method of interrupting further delivery of the stock material subsequent to a break along either the sliver, the attenuated strand or the formed yarn. The sliver stop motion is positioned on a spinning frame for spinning sliver into yarn and winding the yarn onto a spindle. The sliver stop motion is mounted to the spinning frame so as to extend above the back drafting rolls for stopping the motion of sliver being drafted by the back drafting rolls responsive to a break in yarn being wound onto the spindle.

The stop motion includes an elongate pivoting member which is pivotally mounted to a frame mounting member. The pivot point of the elongate pivoting member is readily adjustable so that the sliver stop motion applies minimal tension to the formed yarn while accommodating various machines having various yarn tension requirements. The frame mounting member is, itself, pivotally mounted to the spinning frame to accommodate unavoidable jolts to an individual sliver stop motion and to permit the stop motion to be readily moved for machine maintenance. At the stop motion's proximal end, a yarn contact member extends outwardly therefrom so as to extend below the drafting roll and slidably contact yarn being directed to the respective spindle. A sliver comb is connected to and extends outwardly from the distal end of the elongate pivoting member so as to overlie sliver being drafted by the back drafting rolls. Therefore, during a break in yarn being wound onto the spindle or otherwise, the yarn contact member responsively moves upward from the broken yarn and the sliver comb responsively moves downward to engage the sliver during pivotal movement of the elongate pivoting member. The sliver engaged by the sliver comb is responsively broken due, at least, to the forces of the continuously operating drafting rolls and the retention of the sliver by the sliver comb.

The method of interrupting sliver on a sliver spinning apparatus when a break of the attenuated strand occurs is also provided. The method includes positioning a sliver source to provide sliver to the spinning frame and drafting the sliver with at least one drafting roll positioned downstream of the sliver source. Then, the yarn wound about a spindle while a break along the sliver of the yarn is simultaneously detected. When a break occurs, the delivery of further sliver to the spinning frame is halted by penetrating the sliver with a distal portion of the stop motion while continuously drawing the sliver through the drafting rolls wherein the sliver secured by the stop motion is retained therebehind and the sliver is severed therebelow.

BRIEF DESCRIPTION OF THE FIGURES

The foregoing and other objects, features, and advantages of the present invention will be made apparent from the following detailed description of the preferred embodiment of the invention from the drawings, in which.

DETAILED DESCRIPTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

In the disclosure which follows, reference will be had to one side of the textile machine. It is to be understood that description of this invention in this context is intended for brevity, and it is contemplated that both sides of the textile machine may be serviced simultaneously in accordance with the teachings of the present invention.

Figure 1:
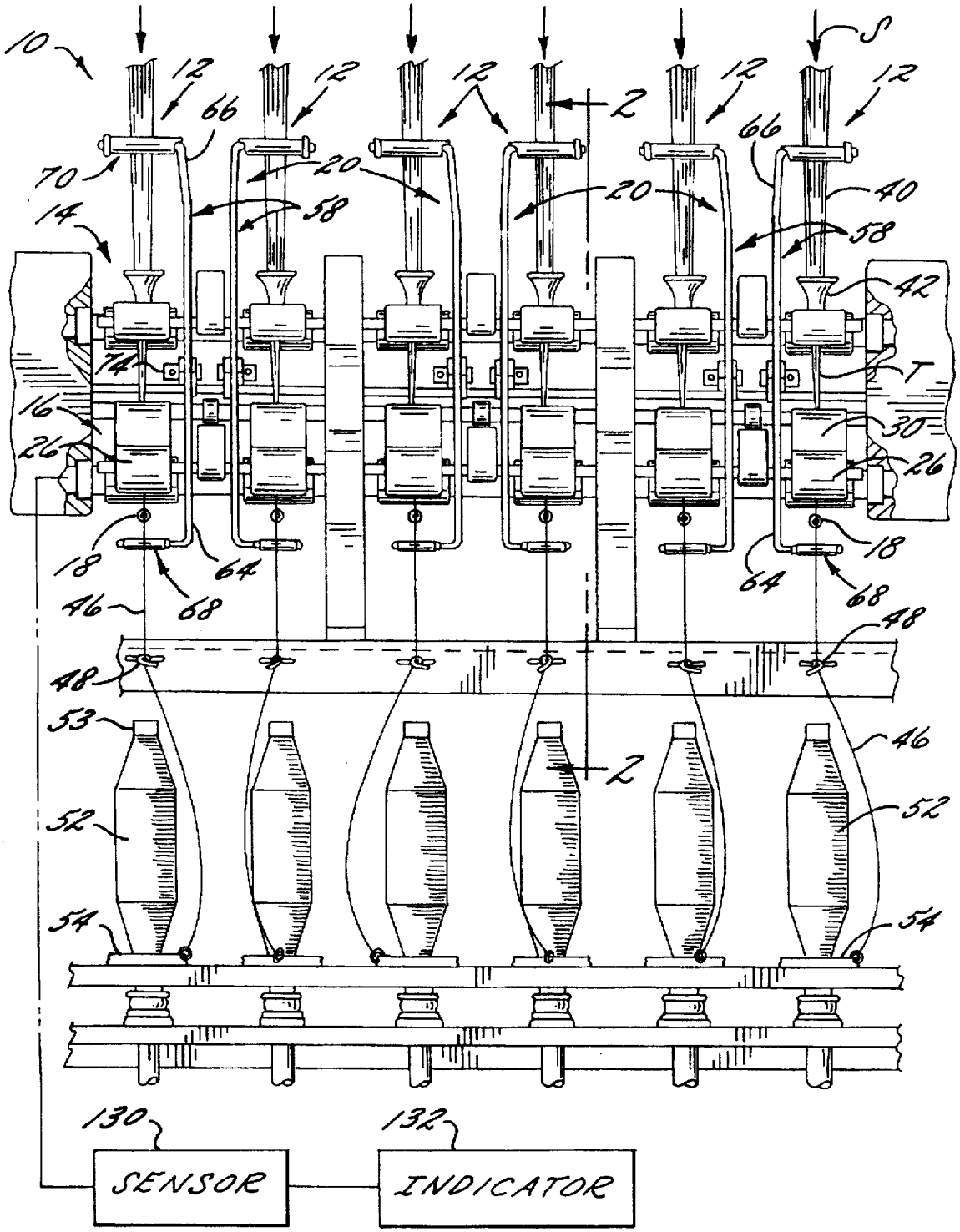
FIG. 1 is a front perspective view of a portion of a spinning frame having a plurality of drafting systems with a sliver stop motion mounted each respective drafting system.
Figure 2:
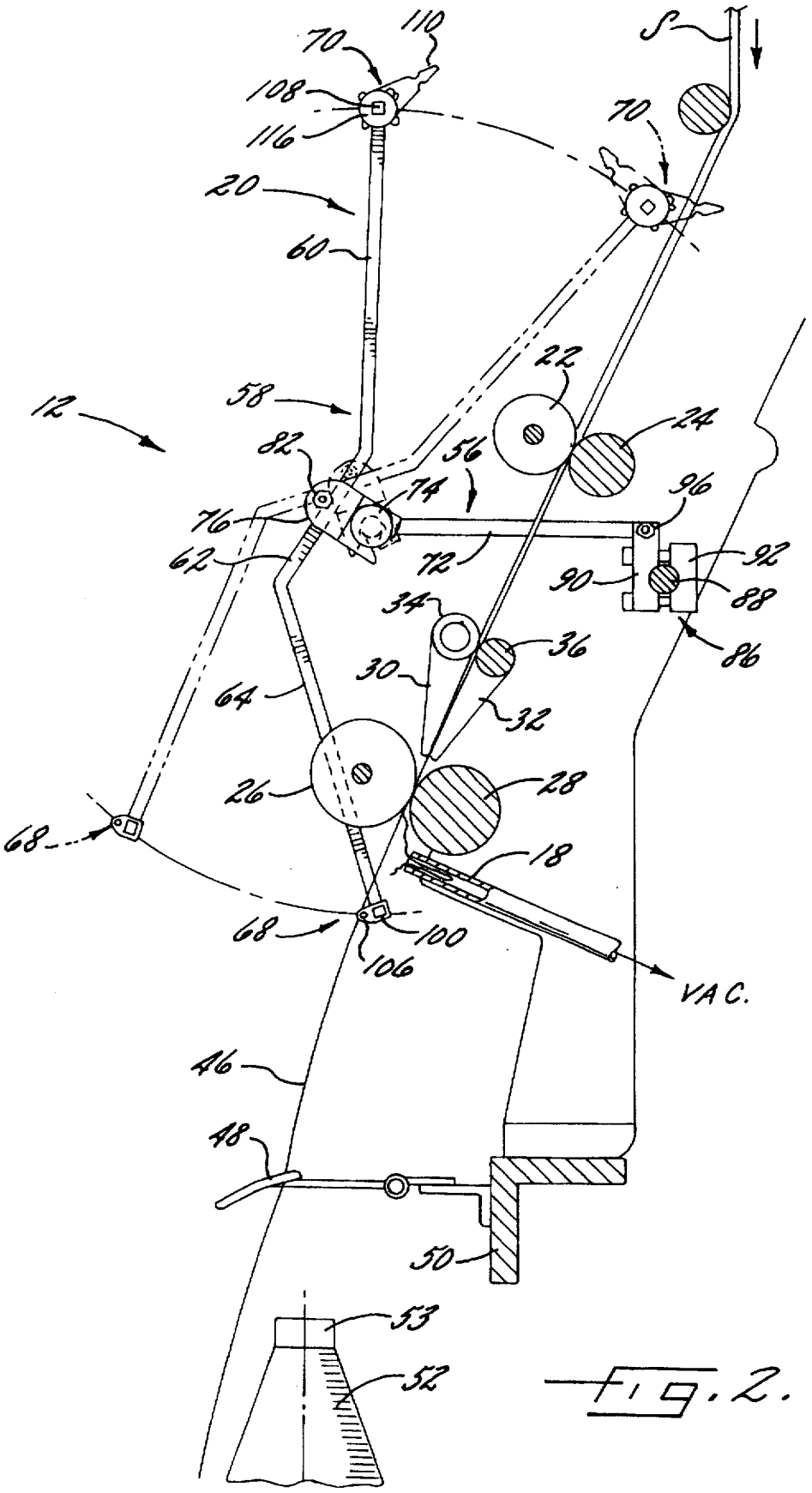
FIG. 2 is a cross-sectional view taken at line 2—2 of FIG. 1.

The textile machine shown particularly in FIGS. 1 and 2 is a spinning frame 10 and includes a plurality of drafting systems 12 arranged in a series along the machine. Typically, and as illustrated, such drafting systems include arrangements of paired rollers through which textile material passes to be drafted and attenuated. Each of the drafting systems normally receives at least one corresponding sliver source S indicated schematically by the arrows of FIG. 1.

While the invention is shown and described as relating to a single drafting system, double or multiple systems are within the scope of the instant invention. Packages of prepared sliver are commonly suspended in a creel section (not shown) of the textile machine and strands are led from respective ones of the packages downwardly to be introduced into the back drafting rolls 14. The textile material is passed through the back drafting rolls 14 to the front drafting rolls 16 as an attenuated strand T. Downstream from the front drafting rolls 16, the attenuated strand T has twist (not shown) inserted thereinto in a generally known manner in order to form yarn. If breakage of the attenuated strand T or the formed yarn issuing from the drafting systems occur, a vacuum end collection nozzle 18 draws materials delivered through the drafting rolls into a waste collection chamber (not shown). Such vacuum end collection systems 18 are conventional to textile yarn forming machines.

Two sets of paired drafting rolls, i.e., the back drafting rolls 14 and front drafting rolls 16, are shown in FIGS. 1 and 2, but any number of paired rollers may be utilized on the spinning frame 10. As shown, the back drafting rolls 14 include a back top-roll 22 and a back bottom-roll 24. The front drafting rolls 16 include a front top-roll 26 and a front bottom-roll 28. Positioned between the back drafting rolls 14 and the front drafting rolls 16 are a top apron 30 and bottom apron 32 having a respective middle top roll 34 and middle bottom roll 36 which provide a contact surface on opposing sides of the attenuated strand T as is common in the textile art.

The sliver source indicated generally at S thereby provides sliver 40 to the spinning frame 10 which is positioned downstream therefrom as shown in the various figures. In operation, the sliver 40 is provided to each drafting system 12, entering through the trumpet 42 under the force of the back drafting rolls 14. As the sliver passes from the back drafting rolls 14 through the aprons 30 and 32 and to the front drafting rolls 16 it is attenuated and drafted. The now attenuated strand 44 then issues from the front drafting rolls 16 wherein twist is added to the attenuated strand as is commonly known in the art. The formed yarn 46 passes the vacuum end collection nozzle 18 and extends through a respective thread guide 48 wherein it is wound about a rotating spindle 53 to form a yarn package 52, as is well known in the art.

A plurality of thread guides 48 are provided and are mounted to a roller beam 50 and are positionally aligned with the respective spindle 53 for winding the formed yarn. The peculiar shape of the thread guide 48 is known in the textile industry as a "pig tail". Also provided is a balloon control ring 54 positioned concentrically around each spindle 53 as is commonly known in the art. The balloon rings 54 assist in the proper winding of the formed yarn 46 onto the spindle 53.

Mounted at each of the drafting systems 12 of the spinning frame 10 is a sliver stop motion 20. The sliver stop motion 20 is mounted to the drafting system 12 of the spinning frame 10 for stopping the motion of sliver being drafted by the drafting rolls 14 or 16 responsive to a break in yarn being wound onto the spindle 53. Each of the sliver stop motions 20 includes a frame mounting member 56 and an elongate pivoting member 58 which is pivotally mounted to the frame mounting member 56 so that the elongate pivoting member overlies at least the back drafting rolls 14. As shown particularly in FIGS. 1–3, the elongate pivoting member 58 of the sliver stop motion 20 includes distal 60, medial 62, and proximal 64 portions.

The medial portion 62 of the elongate pivoting member 58 is pivotally mounted to the frame mounting member 56 as will be discussed in more detail below. The proximal portion 64 extends downwardly from the medial portion 62 at an obtuse angle with respect to the medial portion 62 so that the elongate pivoting member 58 extends alongside and downwardly below the drafting rolls 16. The distal portion 60 extends upwardly from the medial portion 62 which, in a preferred embodiment, extends upwardly at an obtuse angle with respect to the medial portion 62 so as to project above the drafting rolls 14 and the trumpet 42. The distal portion 60 also includes an angled portion 66 which extends inwardly at an acute angle with respect to the longitudinal axis. The angled portion 66 permits the sliver stop motion to be positioned to the side a the drafting rolls 14 and 16 a predetermined distance to provide clearance for the operator behind and alongside the proximal portion 64 so the operator is unobstructed when trying to reach the various components of the spinning frame 10, such as the front drafting rolls 16.

As shown in FIG. 1, right hand and left hand sliver stop motions 20 are shown as mirror images. The right hand and left hand sliver stop motions 20 are alternated along the series of drafting systems 12. However, it is within the spirit and scope of this invention to provide various combinations of right hand and left hand sliver stop motions 20, depending on the relevant machine requirements.

The operation of the sliver stop motion 20 will now be described more fully in detail with particular reference to FIG. 2. The proximal end portion 64 of the elongate pivoting member 58 has mounted thereon a yarn contact member 68 which extends outwardly from the elongate pivoting member 58 so as to underlie and slidably contact yarn 46 being directed to the spindle 53. At its opposite end, or its distal end portion 60, the elongate pivoting member 58 has mounted thereon a sliver comb 70 which extends outwardly therefrom to overlie sliver being drafted by the drafting rolls 14 and 16 so that during a break in the yarn being wound onto the yarn package 52 the sliver stop motion 20 assumes an inoperative position (shown in phantom in FIG. 2) wherein sliver delivery is interrupted. The inoperative position is assumed when the yarn contact member 68 responsively moves upward from the broken yarn and the sliver comb 70 responsively moves downward to engage sliver during the pivotal movement of the elongate pivoting member 58. The sliver engaged by the sliver comb 70 is responsively broken and retained by the sliver comb 70.

The severing of the sliver is achieved, at least in part, by the continued operation of the upper and lower drafting rolls 14 and 16, respectively, and the geometry of the sliver comb 70 (discussed in detail below) wherein the sliver is retained behind the sliver comb 70. The continued operation of the drafting rolls 14 and 16 pulls the sliver positioned below the comb 70 whereby the sliver is responsively broken and the broken end thereof is retained behind the comb 70. The height of the sliver comb 70 is determined by the length of the distal portion 60 of the elongate pivoting member 58. This height is sufficient to provide the sliver stop motion 20 with adequate clearance from the back drafting rolls 14 and yet provide an adequate distance between the sliver comb 70 and the back drafting rolls 14 to facilitate the severing of the sliver S.

Figure 3:
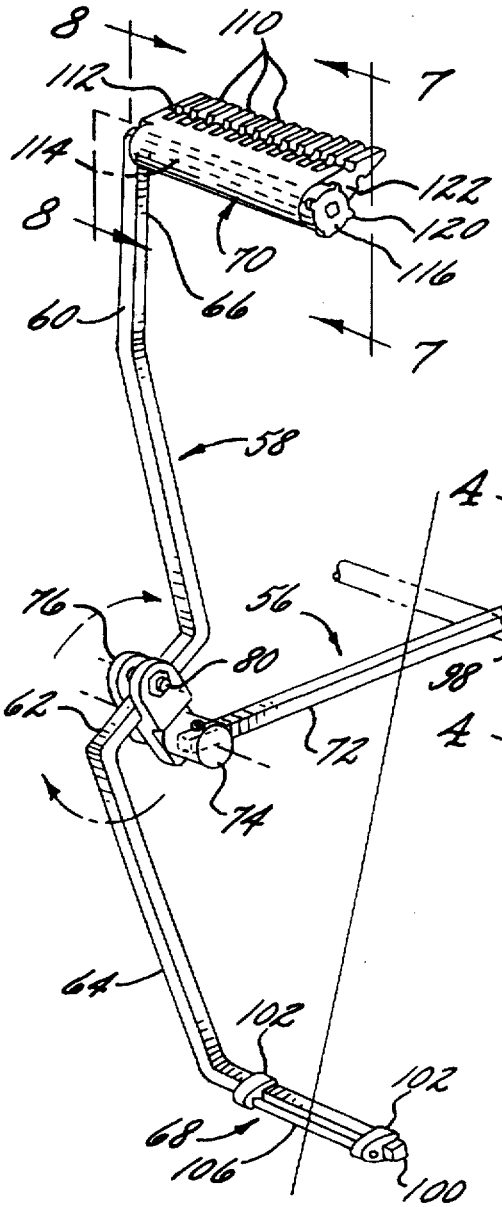
FIG. 3 is a perspective view of the sliver stop motion according to the present invention.
Figure 5:
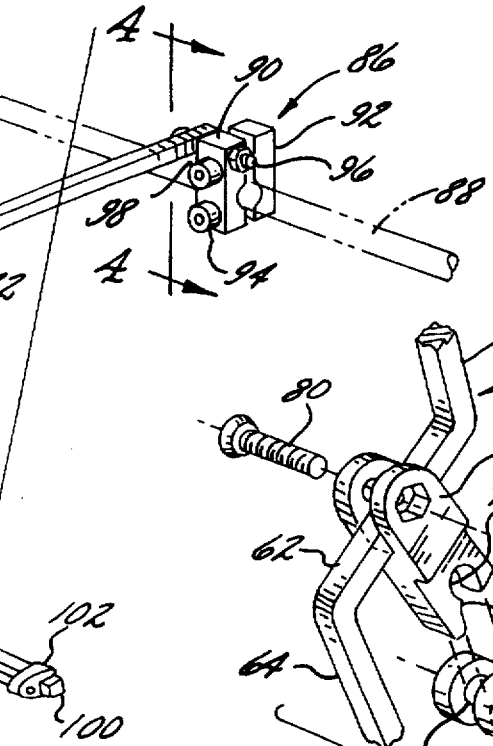
FIG. 5 is an exploded view of the pivotal arrangement of the sliver stop motion.
Figure 5:
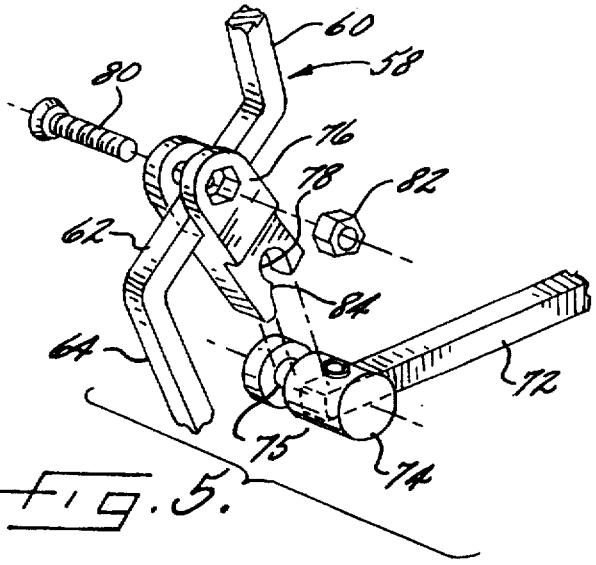

The pivotal arrangement of the elongate pivoting member 58 in relation to the frame mounting member 56 is best illustrated in FIGS. 2, 3 and 5. The frame mounting member 56 includes an elongate rod 72 which includes, at its proximal end, a pivot mounting rod 74 extending outwardly therefrom for detachably mounting the elongate pivoting member 58. The elongate pivoting member 58 includes an adjustable mount 76 having a slot 78 formed in a lower end thereof which extends upwardly at a predetermined angle so that at least a portion 75 of the pivot mounting rod 74 is positioned in the slot 78 for pivotally mounting the elongate pivoting member 58. The adjustable mount 76 comprises, at its opposite end a recess for receiving the medial portion 62 of the elongate pivoting member 58 as shown in FIG. 5. The elongate pivoting member 58 is secured therein by a screw 80 and nut 82. Of course, other mechanical connections may be utilized.

As shown in FIG. 5, the elongate pivoting member 58 is readily removable from the pivot mounting rod 74 due, in part, to the configuration of the slot 78. As shown, the slot 78 includes a protrusion 84 to provide a snap-fit arrangement between the adjustable mount 76 and the pivot mounting rod 74. Thus, the elongate pivoting member 58 may merely be pulled off of the elongate rod which would require only enough force to pull the protrusion 84 over the pivot mounting rod 74.

Accordingly, the elongate pivoting member 58 pivots from a first operative position wherein the pivoting member 58 extends alongside and above the drafting rolls 14 to a second non-operative position, illustrated in phantom, wherein the sliver comb 70 penetrates the sliver 40 responsive to a break in the yarn thereby freeing the yarn contact member 68 permitting the elongate pivot member to naturally pivot to the second non-operative position.

The structure of the sliver stop motion 20 advantageously provides a versatile manner of interrupting sliver delivery to a drafting system 12 which may be used in various machines requiring various yarn tensions. Even machines made by the same manufacturer may have variances which must be accommodated. Each elongate pivoting member 58 of the sliver stop motions 20 will possess an optimum pivot point due to innumerable factors such as, e.g., the weight of the comb, the tension of the yarn, the height of the distal portion 60 of the elongate pivoting member 58, etc. Thus, to accommodate each individual machine and, for that matter, each drafting system 12, the pivot point of the elongate member 58 is easily adjustable. The screw 80 and nut 82 may be removed and the adjustable mount 76 may be repositioned along the medial portion 62 of the elongate member 58. This feature is also useful in adjusting the amount of tension on the yarn due to the contact of the yarn contact member 68 thereagainst. This, too, may vary from machine to machine. Also, the sliver stop motion 20 may be used with various frame mounting member 56, one of which is discussed below with reference to FIG. 10. To further achieve the optimum pivotal movement, separate weights (not shown) may be applied to various locations along the length of the elongate pivoting member 58. Indeed, a versatile sliver stop motion is provided which accommodates all applications and all types of machines.

A second pivot location is provided between the frame mounting member 56 and the spinning frame 10. This feature, minimally, serves at least two important functions. First, it permits the sliver stop motion 20 to move vertically should the sliver stop motion be unavoidably or accidentally jarred, as commonly occurs. This ensures that a jolt to the spinning frame 10 will not cause the sliver stop motion 20 to pivot or produce inadvertent tension against the yarn when, indeed, there is no break therealong. Second, this feature permits the sliver stop motion 20 or, if the elongate pivoting member 58 is removed, the elongate rod 72, to be pivoted upward by the operator to permit access to the respective drafting system 12. As particularly shown in FIGS. 2–4, the elongate rod 72 is pivotally mounted to a frame fastener 86 which, in turn, is mounted to a mounting bar 88 of the spinning frame 10.

Figure 4:
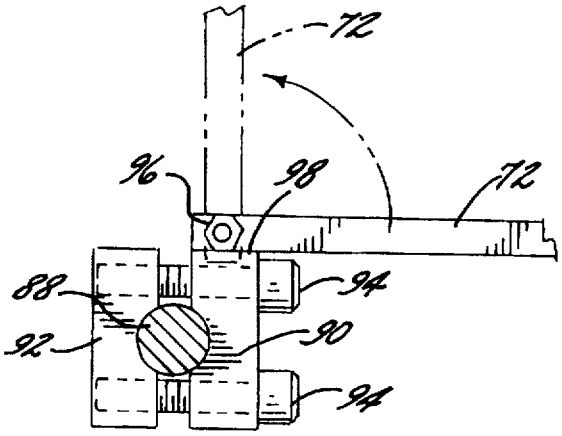
FIG. 4 is a cross-sectional view taken at line 4—4 of FIG. 3.

The frame fastener 86 permits the elongate rod 72 to assume a first operative position as shown in FIG. 3 and FIG. 4 and a second inoperative position as shown in phantom in FIG. 4. This permits the sliver stop motion 20 to be lifted upward by the operator and, in effect, be moved out of the way to permit access to the drafting rolls such as, for example, for normal maintenance of the spinning frame 10. The frame fastener 86 includes a front mounting block 90 and a rear mounting block 92 which are positioned on either side of the mounting bar 88 and are secured by screws 94. The front mounting block 90 defines an elongate channel for receiving a mounting pin or screw 96 which is threaded through the front block 90 of the frame fastener 86 and extends through the elongate rod 72 wherein a nut or other means 96 secures the components together. A stop 98 is provided to limit the pivotal movement of the elongate rod in relation to the mounting bar 88 of the spinning frame 10 and, as shown, is in the form of an elongate member extending transverse to the front block 90 of the frame fastener 86. Indeed, the sliver stop motion 20 is easily mounted to and removed from the spinning frame 10.

Figure 6:
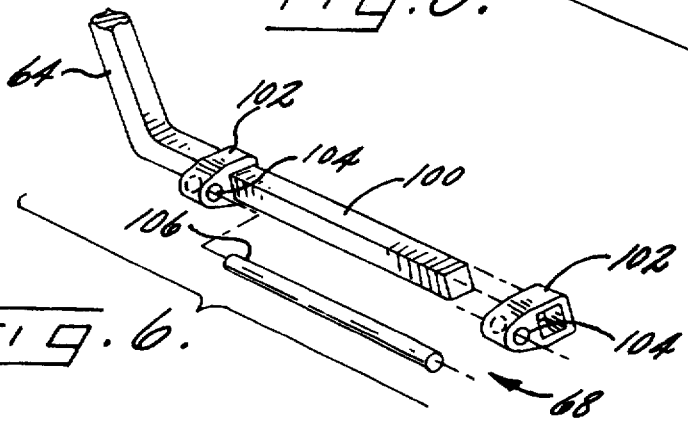
FIG. 6 is an exploded view of the yarn contacting member and the proximal portion of the sliver stop motion.

The sliver stop motion 20 is retained in the operative position when the yarn contact member 68 contacts the yarn 46 being spun about the spindle 53. As best illustrated in the exploded view of FIG. 6, the yarn contact member extends outwardly from the proximal portion 64 of the elongate pivoting member 58 and as shown, preferably forms a right angle thereto. An elongate support 100 extends perpendicular to the proximal end of the elongate pivoting member 58. Mounted in a spaced apart arrangement on the elongate support 100 are support brackets 102 which receive, through apertures 104, a frictional contact member 106 which, as shown, preferably is in the form of a rod. Preferably, the yarn frictional contact member 106 is formed of a smooth, hard material such as carbon steel or other metal which provides minimal friction against the yarn to thereby avoid affecting tension of the yarn as it is being processed. Preferably, the frictional contact member is 3/16" in diameter. However, in an alternative embodiment, a ceramic or chrome plated material may be selected and, for that matter, it is within the spirit of the scope of the present invention to utilize any material for forming the yarn contacting surface. The frictional contact member 106, as shown, is shorter in length than the elongate support 100, but the contact member 106 may be any desired length.

At the opposite, or distal, end of the elongate pivoting member 58 is mounted the sliver comb 70. As shown enlarged in FIGS. 7–9, the sliver comb 70 is mounted on laterally extending pivoting mount 108 which, as shown, is integral with and perpendicular to the distal end of the distal portion 60 of the elongate pivoting member 58. The sliver comb 70 includes a plurality of comb teeth 110 wherein each of the comb teeth 110 include a barb 112 integrally formed therein for operatively retaining sliver in the comb so that sliver responsively breaks when it is retained by the comb 70 and during the operative movement of the drafting rolls.

Figure 7:
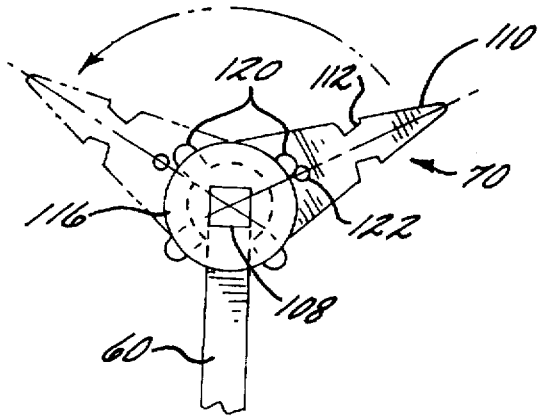
FIG. 7 is an enlarged side elevational view.
Figure 8:
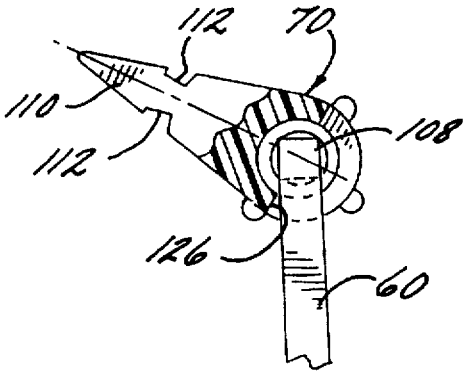
FIG. 8 is a side view with a portion shown in cross-section taken along 8—8 of FIG. 3.
Figure 9:
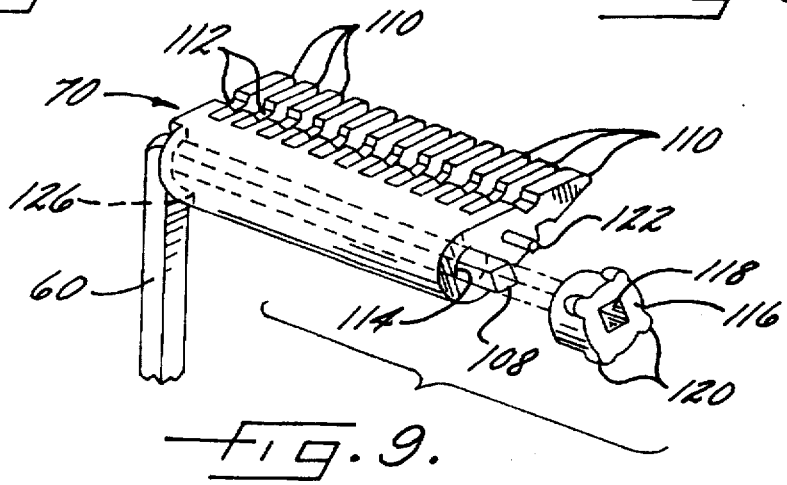
FIG. 9 is an exploded view of the comb mounted on the distal end of the sliver stop motion.

The sliver comb 70 geometry, as best shown in FIGS. 7–9, does not require a plate or other means positioned on the opposing side of the sliver S for the severing to occur. The thicknesses of the teeth and distances therebetween provide a sufficient surface to catch the sliver without permitting the sliver S to roll thereover. The sliver comb 70 geometry works with the movement of the sliver and the pivotal movement of the sliver stop motion 20 to facilitate the penetration of the sliver comb 70 into the sliver S. Otherwise, if the sliver comb 70 were to easily penetrate the sliver S, it would be difficult to pull the sliver out of the comb such as to re-thread the machine. Further, the sliver comb 70 geometry ensures that the sliver S will break quickly and, in a preferred embodiment, break in less than five seconds. Advantageously, the sliver is not only severed to interrupt further delivery thereof, but it also retained behind the sliver comb 70. This permits easy reinstitution of the drafting system 12 by an operator and prevents any loose sliver from interrupting adjacent drafting systems.

The sliver comb geometry also ensures that the sliver comb 70 will not penetrate the sliver if it inadvertently contacts the sliver when no break occurs. This may occur such as when the machine is being doffed. Although the comb may penetrate the sliver somewhat, the barb likely will not penetrate and catch the sliver, absent the operation of the drafting rolls 14 and 16 and/or the pivotal movement of the sliver stop motion 20.

The sliver comb 70 defines an annular aperture 114 extending transverse to the direction of the comb teeth for receiving the laterally extending pivoting mount 108. As shown, the laterally extending pivoting mount 108 possesses a square configuration and the aperture for receiving the laterally extending pivoting mount 108 of the sliver comb 70 is an annular aperture 114. As such, the diameter of aperture 114 is greater than the width of the laterally extending pivoting mount 108, permitting the sliver comb 70 to rotate upon the laterally extending pivoting mount 108. Thus, the sliver comb 70 may be rotated from a first position directed toward the sliver being drafted by the drafting rolls 14 and 16, such as when the spinning frame is operating, to a second position directed away from the sliver after breakage of the sliver, such as when the machine is reinstituted.

The total range of rotation of the sliver comb 20 in relation to the laterally extending pivoting mount is defined by a shoulder portion 26 of the sliver comb 20 which abuts a portion of the distal portion 60 of the elongate pivoting member 58 shown in FIGS. 2 and 8. To provide incremental positions of the sliver comb 20 within the permitted range of rotation, a comb fastener 116 is provided. The comb fastener 116 is mounted on the lateral side of the comb 70 which removably retains the comb 70 on the laterally extending pivoting mount 108. As shown, the comb fastener 116 comprises a central aperture 118 which is correspondingly configured with the laterally extending pivoting mount 108 such that it is not rotatable thereon. The outer surface of the comb fastener 116 comprises a plurality of stops 120 for abutting a camming surface 122 extending outwardly from the sliver comb 70. Thus, the comb 70 is retained upon the laterally extending pivoting mount 108 and is rotatably mounted thereon to the same incremental positions in a ratchet-like manner. That is, that the pivotal movement of the sliver comb 70 upon the laterally extending pivoting mount 108 is limited by the respective stops 120.

For instance, as best shown in FIG. 7, the sliver comb is shown in the operative position and in phantom in the inoperative position. The sliver comb 70 may be pivoted wherein rotating force must be applied to the sliver comb 70 so that the camming surface 122 overrides the respective stop 120. Thus, incremental positions are provided for the sliver comb 70 rather than permitting it to freely rotate upon the laterally extending pivoting mount 108. This prevents the sliver comb from inadvertently rotating. Typically, the operator will manually apply force to the sliver comb 70 to rotate the same. As shown, four stops 120 are provided. Less or more may be provided, however, without departing from the scope of the invention. An advantage of an even number of stops such as four is that the exact positioning of the comb fastener 120 upon the laterally extending pivoting mount is unimportant since the stop arrangement of the comb fastener is substantially identical on all sides.

Figure 10:
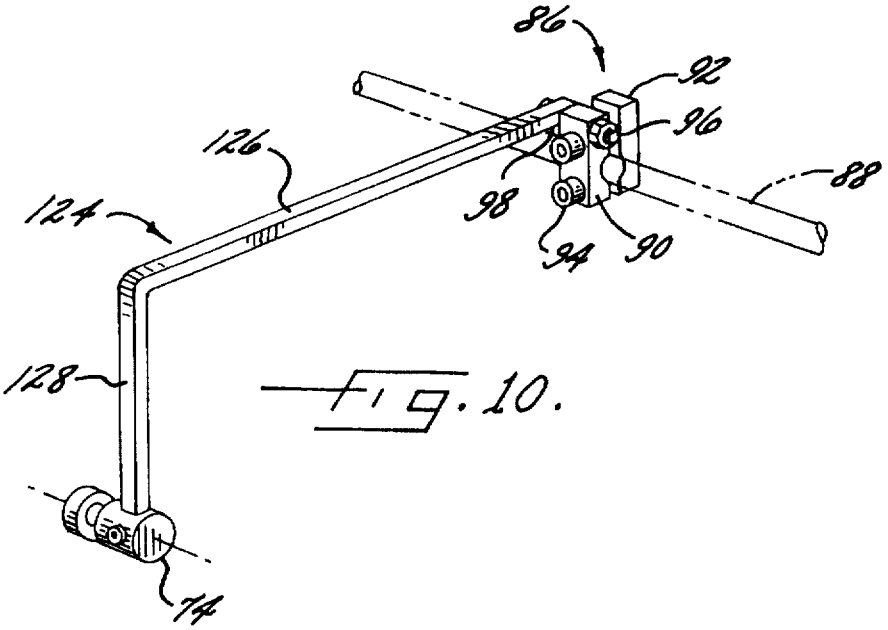
FIG. 10 is a sliver stop motion according to the present invention having an alternative mounting arrangement.

An alternative embodiment is illustrated in FIG. 10 wherein the frame mounting member is differently configured. As shown in FIG. 10, the modified frame mounting member 124 is defined by a horizontally extending portion 126 and a vertically extending portion 128 formed a substantial right angle thereto. This embodiment supports the sliver stop motion of the present invention and provides an alternative support therefor to accommodate various machines.

The present invention may also be incorporated into an automated system wherein the various sliver stop motions 20 along the series of drafting systems 12 of the spinning frame 10 may be automatically monitored. Thus, in addition to the yarn contacting member 68, a sensor 130 may be operatively associated with each of the sliver stop motions 20 to detect the pivotal movement of the sliver stop motion when it pivots to the inoperative position. This may be achieved by detecting the relative position of any portion of the sliver stop motion 20 such as, for example, sensing the operative movement of the sliver comb 70 toward sliver during a yarn breakage. Further, an indicator 132 other than the obvious position of the sliver stop motion after a yarn break, may be provided for indicating the operative condition of the sliver spinning apparatus. For instance, an indicating light (not shown) operatively connected with the sensor may indicate that sliver on a particular drafting system 12 has been interrupted.

The method for interrupting sliver delivery to a drafting system according to the present invention includes positioning a sliver source to provide sliver to the spinning frame and then drafting the sliver in an attenuated strand T with at least one drafting roll 14 or 16 positioned downstream. The formed yarn is then wound about a yarn package 52 supported on the spindle 53 while a break is simultaneously detected. When a break occurs, the present invention stops further sliver from being drawn by the spinning frame by pivoting a sliver stop motion 20 and penetrating the sliver S with a distal portion 60 thereof. This occurs while the sliver is continuously drawn by and through the drafting rolls 14 and/or 16 wherein the sliver secured by the stop motion 20 is retained therebehind and the sliver is severed therebelow. Accordingly, the sliver delivery is efficiently and effectively interrupted.

While particular embodiments of the invention has been described, it will be understood, of course, the invention is not limited thereto since modifications will be made by those skilled in the art, particularly in light of the foregoing teachings. It is, therefore, contemplated by the appended claims to cover any such modifications that incorporate those features of these improvements in the true spirit and scope of the invention.

That which is claimed:

1. An apparatus for spinning sliver into yarn, the apparatus comprising:

a sliver source;

a spinning frame positioned downstream from said sliver source, said spinning frame including at least one drafting roll for drafting sliver from said sliver source to form a yarn therefrom;

a sliver stop motion mounted to said spinning frame for stopping the feed of sliver responsive to a break in yarn being wound onto said yarn package, said stop motion comprising a frame mounting member mounted to said spinning frame, an elongate pivoting member, an adjustable mount mounting said elongate pivoting member to said frame mounting member for pivoting movement about a pivot point between an inactive position during normal yarn production and an active position responsive to a yarn break, said adjustable mount being adjustably positionable along the length of said elongate pivoting member to permit adjusting the pivot point on said elongate pivoting member, a yarn contact member connected to a proximal end of said elongate pivoting member and positioned to slidably contact yarn being directed to said yarn package to bias said pivoting member toward said inactive position so long as a yarn is present, and a sliver catching device connected to a distal end of said elongate pivoting member, said sliver catching device being positioned out of contact with sliver when said pivoting member is in said inactive position, but positioned in contact with sliver when said pivoting member moves to said active position upon a break in yarn whereby sliver engaged by said sliver catching device is responsively broken and solely retained by said sliver catching device.

2. An apparatus as defined in claim 1, wherein said elongate pivoting member has a medial portion, a distal portion connected to and extending upstream from said medial portion at an obtuse angle therefrom, the distal portion including the distal end of said elongate pivoting member and also having portions thereof extending alongside said at least one drafting roll so that the distal end extends upstream from said at least one drafting roll, and a proximal portion connected to and extending downstream from said medial portion at an obtuse angle therefrom, the proximal portion including the proximal end of said elongate pivoting member, and wherein said adjustable mount is positioned on said medial portion.

3. An apparatus as defined in claim 1, wherein said yarn contact member of said sliver stop motion comprises an elongate yarn contact rod connected to the proximal end of said elongate pivoting member and a frictional contact member detachably mounted to said elongate yarn contact rod for frictional contact with yarn being wound to the spindle.

4. An apparatus as defined in claim 1, further comprising a sensor operatively associated with said sliver stop motion for sensing operative movement of said sliver catching device toward sliver upon yarn breakage and at least one indicator responsive to said sensor.

5. An apparatus as defined in claim 1, wherein said frame mounting member comprises an elongate rod and a pivot mounting rod connected to and extending outwardly from a proximal end of said elongate rod for detachably mounting said adjustable mount thereto, said adjustable mount including a slot formed in a lower end thereof for receiving a portion of said pivot mounting rod to permit a detachable and adjustable mount for said elongate pivoting member.

6. An apparatus as defined in claim 1, wherein said frame mounting member includes a frame fastener fastened to the spinning frame and an elongate rod having one end thereof pivotally mounted to said frame fastener and an opposite end thereof connected to said adjustable mount so that upon pivotal movement of said elongate rod the sliver stop motion is moved from a first operative position for stopping the feed of the sliver responsive to a yarn break to a second non-operative position to allow for adjustments by an operator upon yarn breakage.

7. An apparatus for spinning sliver into yarn, the apparatus comprising:

a sliver source;

a spinning frame system positioned downstream from said sliver source, said spinning frame including at least one drafting roll for drafting sliver from said sliver source;

a yarn package positioned to receive the yarn from said at least one drafting roll;

a sliver stop motion mounted to said spinning frame for stopping the feed of sliver responsive to a break in yarn being wound onto said yarn package, said stop motion comprising a frame mounting member configured to pivotally mount said stop motion to said spinning frame so that said stop motion pivots from a first operative position wherein said sliver stop motion extends alongside and upstream from said drafting rolls to a second non-operative position to allow for adjustments by an operator during yarn breakage, an elongate pivoting member mounted to said frame mounting member for movement between an inactive position during normal yarn production and an active position responsive to a yarn break, a yarn contact member connected to a proximal end of said elongate pivoting member and positioned to slidably contact yarn being directed to said yarn package to bias said pivoting member toward said inactive position so long as a yarn is present, and a sliver catching device connected to a distal end of said elongate pivoting member, said sliver catching device being positioned out of contact with said sliver when said pivoting member is in said inactive position, but positioned in contact with said sliver when said pivoting member is in said active position upon a break in yarn whereby sliver engaged by said sliver catching device is responsively broken and solely retained by said sliver catching device.

8. An apparatus as defined in claim 7, wherein said frame mounting member of said sliver stop motion includes a frame fastener mounted to said spinning frame for fastening said stop motion to said spinning frame and an elongate rod pivotally mounted to said frame fastener so that said elongate rod pivots from a first operative position wherein said elongate pivoting member extends alongside and upstream from said drafting rolls to a second non-operative position to allow for adjustments by an operator during yarn breakage, and wherein said elongate pivoting member detachably mounts to said elongate rod.

9. An apparatus as defined in claim 7, wherein said frame mounting member includes a pivot mounting rod connected to said elongate pivoting member for detachably mounting said elongate pivoting member thereto, said elongate pivoting member including a mounting member having a slot formed in a lower end thereof which extends upwardly at a predetermined angle so that at least a portion of said pivot mounting rod is positioned in said slot for mounting said elongate pivoting member.

10. An apparatus for spinning sliver into yarn, the apparatus comprising:

a sliver source;

a spinning frame system positioned downstream from said sliver source, said spinning frame including at least one drafting roll for drafting sliver from said sliver source;

a yarn package positioned to receive the yarn from said at least one drafting roll;

a sliver stop motion mounted to said spinning frame for stopping the feed of sliver responsive to a break in yarn being wound onto said yarn package, said stop motion comprising a frame mounting member mounted to said spinning frame so that said stop motion pivots from a first operative position and an elongate pivoting member pivotally mounted to said frame mounting member for pivoting movement between an inactive position during normal yarn production and an active position responsive to a yarn break, a yarn contact member connected to a proximal end of said elongate pivoting member and positioned to slidably contact yarn being directed to said yarn package to bias said pivoting member toward said inactive position so long as a yarn is present, and a sliver catching device comprising a plurality of teeth, said sliver catching device being connected to a distal end of said elongate pivoting member and rotatably mounted to the distal end of said elongate pivoting member for rotating said plurality of teeth from a first position directed toward sliver being drafted by said at least one drafting roll to a second position directed away from sliver after breakage of the sliver so that upon a break in sliver engaged by said sliver catching device is responsively broken and solely retained by said sliver catching device.

11. An apparatus as defined in claim 10, wherein at least one of said plurality of teeth includes a barb integrally formed in and spaced apart from a distal end of the at least one of said plurality of teeth for operatively retaining sliver in said sliver catching device so that sliver responsively breaks during operative movement of said at least one drafting roll when said sliver catching device operatively engages sliver.

12. An apparatus as defined in claim 11, wherein said sliver catching device includes a laterally extending aperture for receiving a laterally extending pivoting mount positioned at the distal end of said elongate pivoting member for pivotally mounting said sliver catching device to the sliver stop motion.

13. An apparatus as defined in claim 12, further comprising a fastener positioned in operative engagement with said sliver catching device and said pivoting mount for detachably fastening said sliver catching device in the first and second positions.

14. A sliver stop motion for mounting to a spinning frame for stopping the motion of sliver being drafted downstream from a sliver source by the spinning frame, the sliver stop motion comprising:

an elongate frame mounting member;

an elongate pivoting member pivotally mounted to said frame mounting member for movement between an inactive position during normal yarn production and an active position responsive to a yarn break, said elongate pivoting member having a medial portion, a distal portion connected to and extending upstream from said medial portion at an obtuse angle therefrom, and a proximal portion connected to and extending downstream from said medial portion at an obtuse angle therefrom;

a yarn contact member connected to a proximal end of said elongate pivoting member positioned to slidably contact yarn being directed to a spindle to bias said pivoting member toward said inactive position so long as yarn is present; and a sliver comb connected to a distal end of said elongate pivoting member so that during a break in yarn said contact member responsively pivots from said inactive position to said active position whereby sliver engaged by said sliver comb is responsively broken and retained therebehind.

15. A sliver stop motion as defined in claim 14, wherein said frame mounting member of said sliver stop motion includes a frame fastener for supporting said stop motion and an elongate rod pivotally mounted to said frame fastener so that said elongate rod pivots from a first operative position wherein said comb is substantially not in contact with the sliver to a second non-operative position to allow for adjustments by an operator during yarn breakage.

16. A sliver stop motion as defined in claim 15, wherein said frame mounting member further includes a pivot mounting rod connected to a proximal end of said elongate rod for detachably mounting said elongate pivoting member thereto, said elongate pivoting member including an adjustable mount having a slot formed in a lower end thereof which extends upwardly therefrom at a predetermined angle so that said pivot mounting rod is positioned in said, slot for mounting said elongate pivoting member.

17. A sliver stop motion as defined in claim 14, wherein said yarn contact member of said sliver stop motion comprises an elongate yarn contact rod connected to the proximal end of said elongate pivoting member and a frictional contact member detachably mounted to said elongate yarn contact rod for frictional contact with yarn being processed.

18. A sliver stop motion for mounting to a spinning frame for interrupting the motion of sliver being drafted by the spinning frame comprising:

an elongate frame mounting member;

an elongate pivoting member removably and pivotally mounted to said frame mounting member;

a yarn contact member connected to a proximal end of said elongate pivoting member so as to underlie and slidably contact yarn being processed; and a sliver comb connected to a distal end of said elongate pivoting member, said comb comprising a plurality of comb teeth, at least one of said plurality of comb teeth including a barb integrally formed therein for operatively retaining sliver in said comb so that sliver responsively breaks during operative movement of the spinning frame when said comb operatively engages sliver.

19. A sliver stop motion as defined in claim 18, wherein said comb of said sliver stop motion is further rotatably mounted to the distal end of said elongate pivoting member for rotating said plurality of teeth from a first position directed toward sliver being drafted by the spinning frame to a second position directed away from the sliver.

20. A sliver stop motion as defined in claim 19, further comprising a comb fastener positioned in operative engagement with a portion of said comb for detachably fastening said comb in the first and second positions and providing incremental positions for said sliver comb.

21. A comb for a sliver stop motion to penetrate and sever sliver responsive to a break in an attenuated strand formed from the sliver, the comb comprising a plurality of elongate teeth, at least one of said teeth including a barb formed integrally therewith and spaced apart from a distal end of said at least one of said plurality of elongate teeth for operatively retaining sliver in the comb responsive to a break in the attenuated strand so that sliver retained by the comb responsively breaks when the sliver is being drawn downstream and so that sliver upstream remains retained by the comb, and a pivoting mount for pivotally mounting the comb to the sliver stop motion.

22. A comb as defined in claim 21, further comprising a stop for abutting a camming surface of the sliver stop motion to thereby limit the pivotal movement of the comb relative to the sliver stop motion so that the comb pivots from a first position directed toward sliver being drafted downstream to a second position directed away from the sliver.

23. A method of interrupting sliver delivery to a sliver spinning apparatus for spinning sliver into yarn, the method comprising the steps of:

positioning a sliver source to provide sliver to the spinning frame;

drafting the sliver with at least one drafting roll positioned downstream of said sliver source; and winding the yarn about a yarn package while simultaneously detecting a break along the sliver of the yarn so that when a break occurs, stopping further sliver from being drawn by the spinning frame by pivoting a sliver stop motion, penetrating the sliver with a sliver catching device, and retaining the sliver solely in the sliver catching device while continuously drawing the sliver through the drafting rolls to thereby sever the sliver being drawn downstream while retaining an upstream free end of the severed sliver in the comb.

24. An apparatus for spinning sliver into yarn, the apparatus comprising:

a sliver source;

a spinning frame positioned downstream from said sliver source, said spinning frame including at least one drafting roll for drafting sliver from said sliver source to form a yarn therefrom;

a yarn package arranged on a spindle positioned to receive the yarn from said at least one drafting roll; and a sliver stop motion mounted to said spinning frame for stopping the feed of sliver responsive to a break in yarn being wound onto said yarn package, said stop motion comprising a frame mounting member mounted to said spinning frame, an elongate pivoting member, an adjustable mount mounting said elongate pivoting member to said frame mounting member for pivoting movement about a pivot point between an inactive position during normal yarn production and an active position responsive to a yarn break, said adjustable mount being adjustably positionable along the length of said elongate pivoting member to permit adjusting the pivot point on said elongate pivoting member, said elongate pivoting member having a medial portion, a distal portion connected to and extending upstream from said medial portion at an obtuse angle therefrom, the distal portion including the distal end of said elongate pivoting member and also having portions thereof extending alongside said at least one drafting roll so that the distal end extends upstream from said at least one drafting roll, and a proximal portion connected to and extending downstream from said medial portion at an obtuse angle therefrom, the proximal portion including the proximal end of said elongate pivoting member, and wherein said adjustable mount is positioned on said medial portion, a yarn contact member connected to a proximal end of said elongate pivoting member and positioned to slidably contact yarn being directed to said yarn package to bias said pivoting member toward said inactive position so long as a yarn is present, and a sliver comb connected to a distal end of said elongate pivoting member, said comb being positioned out of contact with sliver when said pivoting member is in said inactive position, but positioned in contact with sliver when said pivoting member moves to said active position upon a break in yarn sliver engaged by said sliver comb is responsively broken and retained by said sliver comb.

25. An apparatus for spinning sliver into yarn, the apparatus comprising:

a sliver source;

a spinning frame positioned downstream from said sliver source, said spinning frame including at least one drafting roll for drafting sliver from said sliver source to form a yarn therefrom;

a yarn package arranged on a spindle positioned to receive the yarn from said at least one drafting roll; and a sliver stop motion mounted to said spinning frame for stopping the feed of sliver responsive to a break in yarn being wound onto said yarn package, said stop motion comprising a frame mounting member mounted to said spinning frame, an elongate pivoting member, an adjustable mount mounting said elongate pivoting member to said frame mounting member for pivoting movement about a pivot point between an inactive position during normal yarn production and an active position responsive to a yarn break, said adjustable mount being adjustably positionable along the length of said elongate pivoting member to permit adjusting the pivot point on said elongate pivoting member, a yarn contact member connected to a proximal end of said elongate pivoting member and positioned to slidably contact yarn being directed to said yarn package to bias said pivoting member toward said inactive position so long as a yarn is present, said yarn contact member comprising an elongate yarn contact rod connected to a proximal end of said elongate pivoting member and a frictional contact member detachably mounted to said elongate yarn contact rod for frictional contact with yarn being wound to the spindle, and a sliver comb connected to a distal end of said elongate pivoting member, said comb being positioned out of contact with sliver when said pivoting member is in said inactive position, but positioned in contact with sliver when said pivoting member moves to said active position upon a break in yarn sliver engaged by said sliver comb is responsively broken and retained by said sliver comb.

26. An apparatus for spinning sliver into yarn, the apparatus comprising:

a sliver source;

a spinning frame positioned downstream from said sliver source, said spinning frame including at least one drafting roll for drafting sliver from said sliver source to form a yarn therefrom;

a yarn package arranged on a spindle positioned to receive the yarn from said at least one drafting roll;

a sliver stop motion mounted to said spinning frame for stopping the feed of sliver responsive to a break in yarn being wound onto said yarn package, said stop motion comprising a frame mounting member mounted to said spinning frame, an elongate pivoting member, an adjustable mount mounting said elongate pivoting member to said frame mounting member for pivoting movement about a pivot point between an inactive position during normal yarn production and an active position responsive to a yarn break, said adjustable mount being adjustably positionable along the length of said elongate pivoting member to permit adjusting the pivot point on said elongate pivoting member, a yarn contact member connected to a proximal end of said elongate pivoting member and positioned to slidably contact yarn being directed to said yarn package to bias said pivoting member toward said inactive position so long as a yarn is present, and a sliver comb connected to a distal end of said elongate pivoting member, said comb being positioned out of contact with sliver when said pivoting member is in said inactive position, but positioned in contact with sliver when said pivoting member moves to said active position upon a break in yarn sliver engaged by said sliver comb is responsively broken and retained by said sliver comb; and a sensor operatively associated with said sliver stop motion for sensing operative movement of said sliver comb toward sliver upon yarn breakage and at least one indicator responsive to said sensor.

27. An apparatus for spinning sliver into yarn, the apparatus comprising:

a sliver source;

a spinning frame system positioned downstream from said sliver source, said spinning frame including at least one drafting roll for drafting sliver from said sliver source;

a yarn package positioned to receive the yarn from said at least one drafting roll;

a sliver stop motion mounted to said spinning frame for stopping the feed of sliver responsive to a break in yarn being wound onto said yarn package, said stop motion comprising a frame mounting member mounted to said spinning frame so that said stop motion pivots from a first operative position and an elongate pivoting member pivotally mounted to said frame mounting member for pivoting movement between an inactive position during normal yarn production and an active position responsive to a yarn break, a yarn contact member connected to a proximal end of said elongate pivoting member and positioned to slidably contact yarn being directed to said yarn package to bias said pivoting member toward said inactive position so long as a yarn is present, and a sliver comb comprising a plurality of teeth, said comb being connected to a distal end of said elongate pivoting member and rotatably mounted to the distal end of said elongate pivoting member for rotating said plurality of teeth from a first position directed toward sliver being drafted by said at least one drafting roll to a second position directed away from sliver after breakage of the sliver, at least one of said plurality of comb teeth including a barb integrally formed in and spaced apart from a distal end of the at least one of said plurality of teeth for operatively retaining sliver in said comb so that sliver responsively breaks during operative movement of said at least one drafting roll when said comb operatively engages sliver and so that upon a break in sliver engaged by said sliver comb the engaged sliver is responsively retained by said sliver comb.

28. An apparatus as defined in claim 27, wherein said comb includes a laterally extending aperture for receiving a laterally extending pivoting mount positioned at the distal end of said elongate pivoting member for pivotally mounting said comb to the sliver stop motion.

29. An apparatus as defined in claim 28, further comprising a comb fastener positioned in operative engagement with said comb and said pivoting mount for detachably fastening said comb in the first and second positions.

* * * * *